US007337475B1

(12) United States Patent
Wood

(10) Patent No.: US 7,337,475 B1
(45) Date of Patent: Mar. 4, 2008

(54) WAVECUP

(76) Inventor: Kerry Wood, 124 Hickory St., Bridgeport, CT (US) 06610

( * ) Notice: Subject to any disclaimer, the term of this patent is extended or adjusted under 35 U.S.C. 154(b) by 169 days.

(21) Appl. No.: 11/032,998

(22) Filed: Jan. 11, 2005

Related U.S. Application Data

(60) Provisional application No. 60/544,821, filed on Feb. 17, 2004.

(51) Int. Cl.
*A42B 1/04* (2006.01)

(52) U.S. Cl. ..... 2/202

(58) Field of Classification Search ..... 2/174, 2/202–204, 207, 184.5, 175.6, 209.13; 132/273, 132/274
See application file for complete search history.

(56) References Cited

U.S. PATENT DOCUMENTS

D277,426 S 2/1985 Eisinger
5,048,128 A * 9/1991 Watson, Jr. ..... 2/204
5,062,157 A * 11/1991 Muta ..... 2/207
5,161,260 A * 11/1992 Reynolds ..... 2/207
5,542,127 A * 8/1996 Bezanis ..... 2/172
D376,681 S * 12/1996 Riesenman et al. ..... D2/879
5,594,956 A * 1/1997 Barrientos ..... 2/207
D402,088 S 12/1998 Edwards
D441,937 S 5/2001 Thibodaux

* cited by examiner

*Primary Examiner*—Katherine M. Moran

(57) ABSTRACT

A cap and cap extension. The cap is a standard cap and includes an incorporated visor. The cap extension is attached to the rear section of the cap and is designed to cover an individual's neck when the individual is wearing the cap. The cap extension includes a design that provides utility in both preventing sun exposure to an individual's neck, while at the same time, being able to flap about in a light breeze.

6 Claims, 3 Drawing Sheets

WAVECUP

I. CROSS-REFERENCE TO RELATED APPLICATIONS

This application claims the benefit of U.S. Provisional Application No. 60/544,821, filed Feb. 17, 2004.

II. BACKGROUND OF THE INVENTION

The present invention concerns that of a new and improved cap and cap extension for use by an individual.

III. DESCRIPTION OF THE PRIOR ART

U.S. Pat. No. 5,542,127, issued to Bezanis, discloses a combination hat comprised of a bandana and visor.

U.S. Pat. No. D441,937, issued to Thibodaux, discloses an ornamental design for a hat and visor.

U.S. Pat. No. D402,088, issued to Edwards, discloses an ornamental design for a hat and visor.

U.S. Pat. No. D277,426, issued to Eisinger, discloses an ornamental design for a hat and visor.

IV. SUMMARY OF THE INVENTION

The present invention concerns that of a new and improved cap and cap extension for use by an individual. The cap is a standard cap and includes an incorporated visor. The cap extension is attached to the rear section of the cap and is designed to cover an individual's neck when the individual is wearing the cap. The cap extension comprises a design that provides utility in both preventing sun exposure to an individual's neck, while at the same time, being able to flap about in a light breeze.

There has thus been outlined, rather broadly, the more important features of a cap and visor combination that the detailed description thereof that follows may be better understood and in order that the present contribution to the art may be better appreciated. There are, of course, additional features of the cap and visor combination that will be described hereinafter and which will form the subject matter of the claims appended hereto.

In this respect, before explaining at least one embodiment of the cap and visor combination in detail, it is to be understood that the cap and visor combination is not limited in its application to the details of construction and to the arrangements of the components set forth in the following description or illustrated in the drawings. The cap and visor combination is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present cap and visor combination. It is important, therefore, that the claims be regarded as including such equivalent constructions insofar as they do not depart from the spirit and scope of the present invention.

It is therefore an object of the present invention to provide a cap and visor combination which has all of the advantages of the prior art and none of the disadvantages.

It is another object of the present invention to provide a cap and visor combination which may be easily and efficiently manufactured and marketed.

It is another object of the present invention to provide a cap and visor combination which is of durable and reliable construction.

It is yet another object of the present invention to provide a cap and visor combination which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
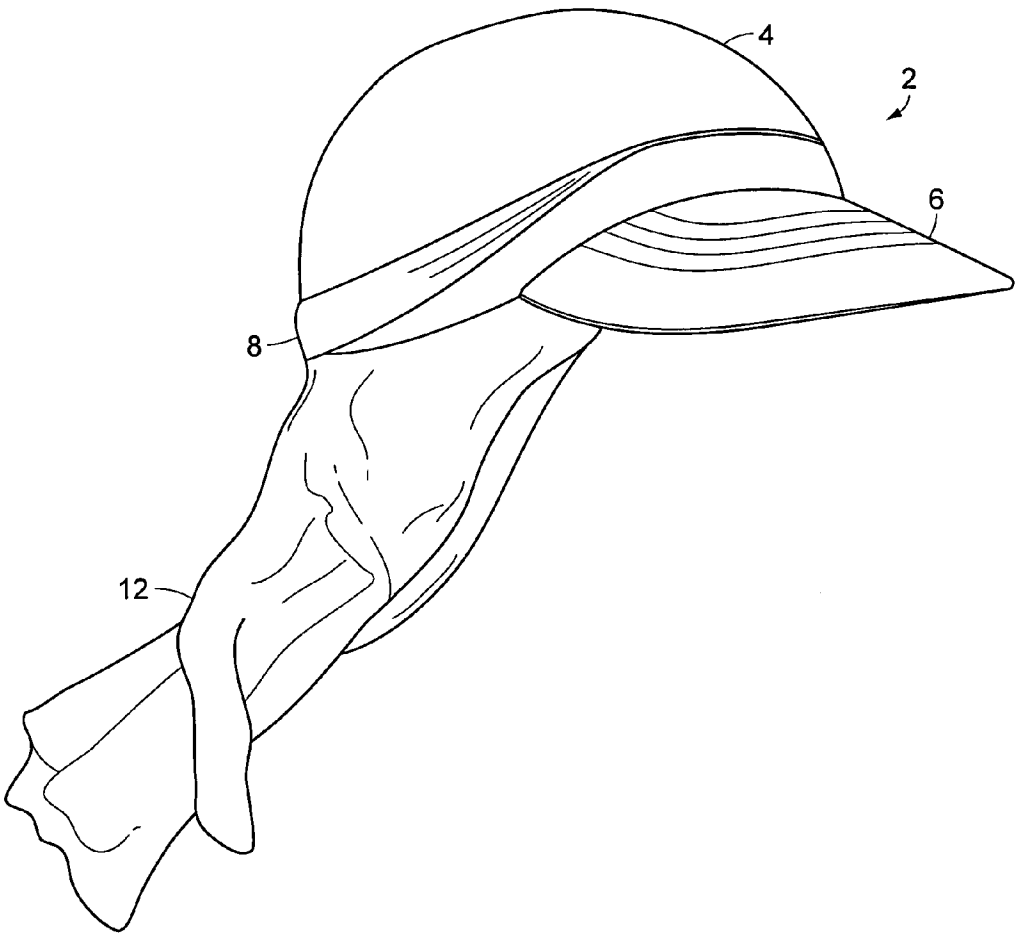
FIG. 1 shows a perspective view of a cap used with the present invention.

FIG. 1 shows a perspective view of a cap 2 used with the present invention. Cap 2 has a central section 4 and a visor 6. Central section 4 has two surfaces, a top surface and a bottom surface, with the bottom surface being placed against an individual's head. The top surface is designed to face upright. Central section 4 also has a continuous perimeter 8 that is roughly circular-shaped.

Central section 4 is bowl-shaped, with the bottom section being concave. This will allow easy placement of central section 4 against the individual's head and will allow it to easily hold once placed in this location.

Visor 6 has two ends, a first end and a second end, and has two surfaces, a top surface and a bottom surface. The first end of visor 6 is attached to the perimeter 8 of the central section 4. Visor 6 is designed to be placed over an individual's face once the central section 4 of cap 2 has been placed over an individual's head. Visor 6 has two sides, a first side and a second side, and has minor curvature extending from the first side to the second side in a manner that has the bottom surface of the visor 6, just like the bottom surface of the central section 4, having a concave shape.

Figure 2:
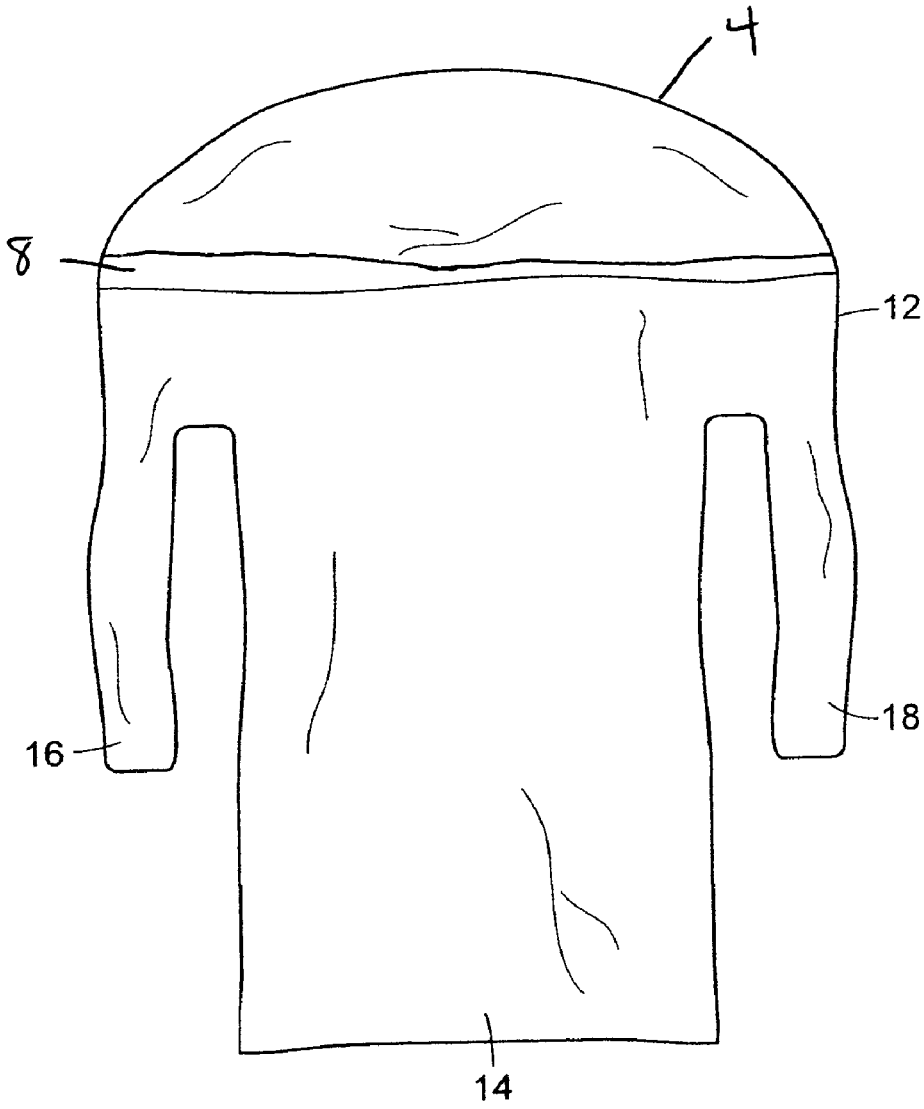
FIG. 2 shows a top view of the extension that is attached to the cap.

FIG. 2 shows a top view of the extension 12 that is attached to the cap. Extension 12 has two ends, a first end and a second end, and has two sides, a first side and a second side.

Extension 12 comprises a main flap 14, left flap 16, and right flap 18, each of which have two ends, a first end and a second end. Left flap 16 and right flap 18 have a smaller length than that of main flap 14. The first end of each of main flap 14, left flap 16, and right flap 18 are all connected at the first end of the extension 12. Extension 12 is preferably made from fabric or cloth.

Figure 3:
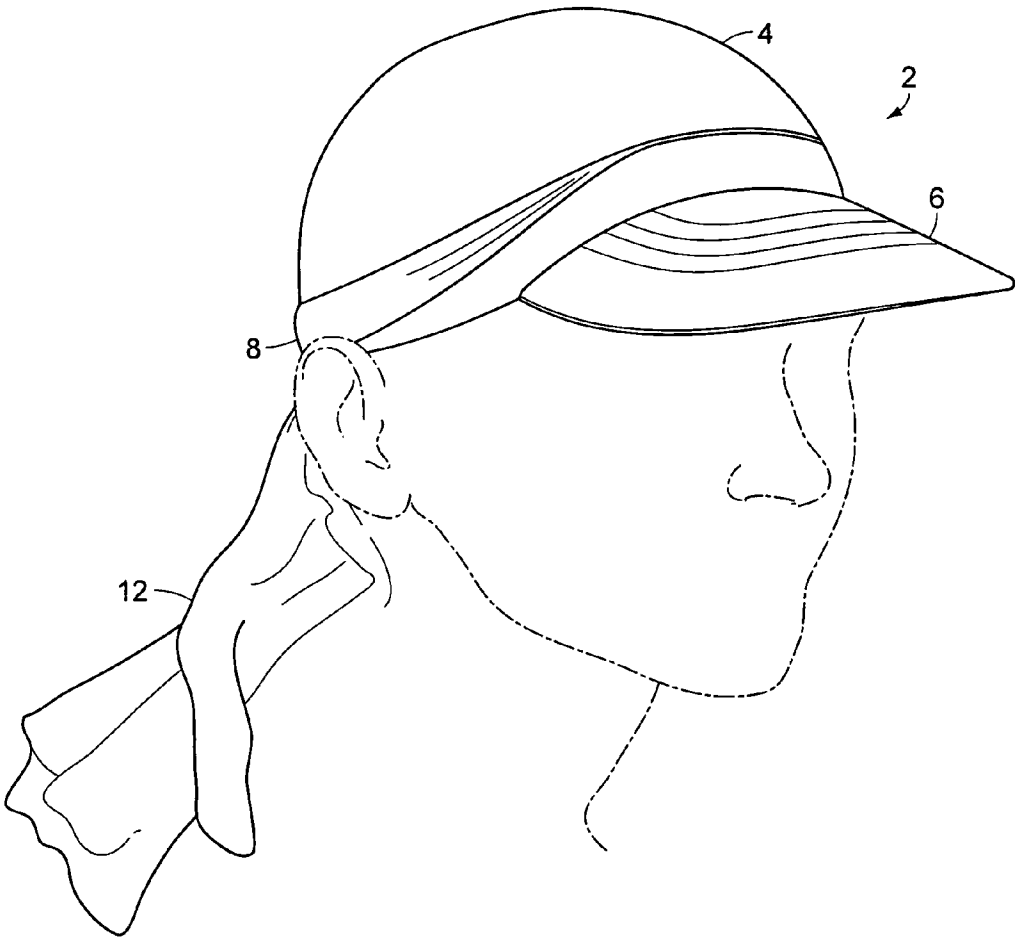
FIG. 3 shows the present invention as it would appear in use.

FIG. 3 shows the present invention as it would appear in use. As can be seen, the first end of the extension 12 is attached to the perimeter 8 of the central section 4 of the cap 2. The first end of the extension 12 is attached to the perimeter 8 of the central section 4 of the cap 2 opposite the location where the visor 6 is attached, because the extension 12 is designed to cover the back of a person's neck. The design of the cap extension 12 provides utility in both preventing sun exposure to an individual's neck, while at the same time, being able to flap about in a light breeze.

The invention claimed is:

1. A head covering comprising:

a cap, having a central section, the central section having two surfaces, a top surface and a bottom surface, the central section also having a continuous perimeter that is roughly circular-shaped, the cap further comprising a visor having two ends, a first end and a second end, the visor also having two surfaces, a top surface and a bottom surface, the first end of the visor being attached to the perimeter of the central section, the visor having two sides, a first side and a second side, the visor having a minor curvature extending from the first side to the second side, and an extension having a first end, a second end, a first side, a second side, a main flap having a first end and a second end, a left flap having a first end and a second end, and a right flap having a first end and a second end wherein the first end of the main flap, the first end of the left flap, and the first end of the right flap all connect to one another at the first end of the extension.

wherein the first end of the extension is attached to the perimeter of the central section of the cap.

2. A head covering according to claim 1 wherein the bottom surface of the central section of the cap is designed to be placed against an individual's head and the top surface of the central section of the cap is designed to face upright.

3. A head covering according to claim 2 wherein the central section is bowl-shaped.

4. A head covering according to claim 3 wherein the visor has a concave shape.

5. A head covering according to claim 1 wherein the extension is fabricated from cloth.

6. A head covering according to claim 1 wherein the extension is fabricated from fabric.

* * * * *